US007007747B2

(12) United States Patent
Kitchens et al.

(10) Patent No.: US 7,007,747 B2
(45) Date of Patent: Mar. 7, 2006

(54) STRUCTURAL SUPPORT APPARATUS WITH ACTIVE OR PASSIVE HEAT TRANSFER SYSTEM

(76) Inventors: Mark Charles Kitchens, 1107 Bel Air, Athens, TX (US) 75751; Regis Marie-Jean Wandres, 7145 St. Hwy. 19 N., Athens, TX (US) 75752

( * ) Notice: Subject to any disclaimer, the term of this patent is extended or adjusted under 35 U.S.C. 154(b) by 351 days.

(21) Appl. No.: 10/689,930

(22) Filed: Oct. 20, 2003

(65) Prior Publication Data

US 2005/0082046 A1 Apr. 21, 2005

(51) Int. Cl.
*B65D 88/74* (2006.01)

(52) U.S. Cl. ..... 165/135; 220/592.24; 220/592.09; 220/592.23; 62/3.6; 62/457.1

(58) Field of Classification Search ..... 165/135; 62/3.6, 457.2; 220/592.24, 592.23, 592
See application file for complete search history.

(56) References Cited

U.S. PATENT DOCUMENTS 4,085,785 A * 4/1978 Hoot ..... 220/592.24
4,297,850 A * 11/1981 Reed ..... 62/3.6
4,326,383 A * 4/1982 Reed et al. ..... 62/3.62
4,537,313 A 8/1985 Workman
4,581,898 A * 4/1986 Preis ..... 62/3.62
5,301,508 A * 4/1994 Kahl et al. ..... 62/3.62
5,367,879 A * 11/1994 Doke et al. ..... 62/3.6
6,021,642 A * 2/2000 Guinn ..... 62/3.6
6,036,047 A * 3/2000 Dobbie ..... 220/592.03
6,206,646 B1 3/2001 Bucher
6,332,712 B1 12/2001 Headley
6,799,434 B1 * 10/2004 Hobbs, Jr. ..... 62/457.9
2001/0010312 A1 * 8/2001 Mogil ..... 220/592.15
2004/0144783 A1 * 7/2004 Anderson et al. ..... 220/23.87
2005/0023282 A1 * 2/2005 Murrer, III ..... 220/592.2
2005/0210912 A1 * 9/2005 Mogil et al. ..... 62/457.7

* cited by examiner

*Primary Examiner*—Allen J. Flanigan

(57) ABSTRACT

Structural support apparatus with active or passive heat transfer system with a flexible insulated container, a rigid heat-conductive metallic element, a heat exchange system, where the metallic element structurally supports the container. The metallic element and container form a waterproof bond, and the metallic element and heat exchange system form a thermal bond. A preferred embodiment includes a flexible insulated container forming a closed volume with a plurality of flexible walls.

10 Claims, 4 Drawing Sheets

STRUCTURAL SUPPORT APPARATUS WITH ACTIVE OR PASSIVE HEAT TRANSFER SYSTEM

BACKGROUND OF THE INVENTION

The present invention generally relates to the field of portable insulated containers and particularly for a structural support for such device having active or passive heat transfer systems.

There are many different types of portable insulated containers on the market today. One common type of portable insulated containers is made of rigid materials. These insulated containers are sturdy, durable, and good insulators. Another common type of portable insulated containers is made of soft and flexible materials. The prior art U.S. Pat. No. 6,332,712 B1 describes a sealed bag made of flexible plastic, unlike a rigid container, the flexible bag described can fold onto itself. This second type of portable insulated container is lightweight and easy to carry. Another prior art as described in U.S. Pat. No. 4,537,313 provides a soft foldable container with improved insulation. This later type is lightweight, easy to carry, and good insulators.

These prior arts utilize passive heat transfer as the insulting means; others rely on active and passive heat transfer as the insulating mean. Prior art U.S. Pat. No. 6,206,646 presents another insulated container made of flexible insulating materials and a thermoelectric element as the active cooling mean.

A major disadvantage of rigid type containers is that they can be quite cumbersome and do not allow adaptability to the wide range of content users might want to place in such device. On the other hand, flexible containers are much less invasive, and adapt to a wider range of use and locations. Unfortunately, because of the flexible property of such containers, they easily deform drastically limiting the carrying capacity and have a limited lifetime. Another disadvantage is the poor insulating performance of flexible containers. The construction of portable active cooling containers does not allow passive cooling as the alternate cooling mean; even less so simultaneously as the use of ice as the cooling mean would damage the conventional active cooling system of such portable containers.

BRIEF SUMMARY OF THE INVENTION

A primary object of the invention is to provide better structural integrity to a flexible insulated container.

Another object of the invention is to provide both active and passive heat exchange mean.

Another object of the invention is to provide a less invasive insulated container yet without loss of capacity.

A further object of the invention is to provide a less expensive apparatus yet with improved durability, performance, and flexibility of use.

In accordance with a preferred embodiment of the present invention, a structural support apparatus with active or passive heat transfer system comprises a flexible insulated container, a rigid heat-conductive metallic element, and a heat exchange system, where the metallic element structurally supports the container, the metallic element and container form a waterproof bond, and the metallic element and heat exchange system form a thermal bond.

Other objects and advantages will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
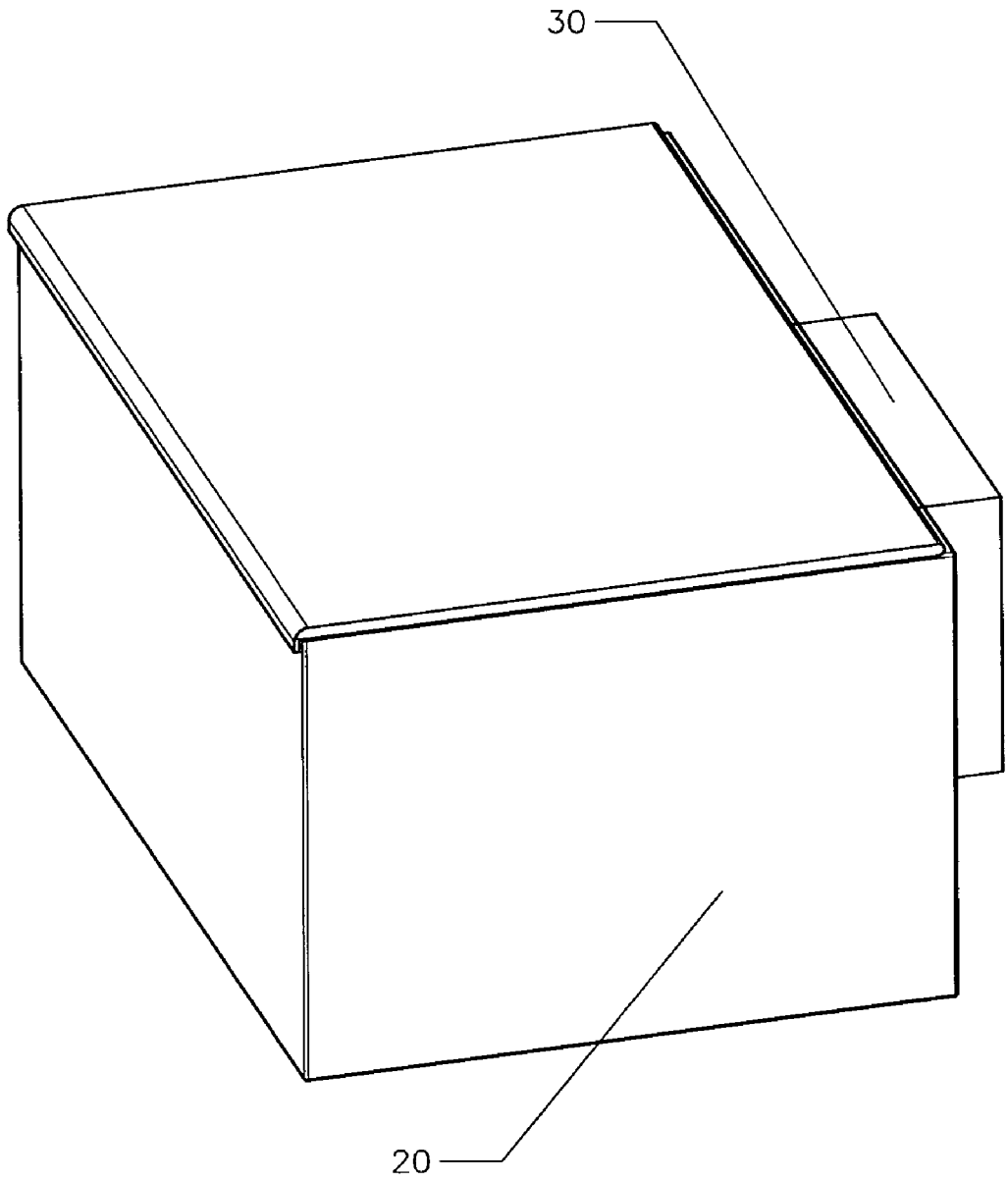
FIG. 1 is a perspective view of a preferred embodiment containing the invention.

Turning first to FIG. 1 there is shown a perspective view of a preferred embodiment of a flexible insulated container 20 wherein the present invention is installed. Flexible insulated container 20 forms a closed volume as shown.

Figure 2:
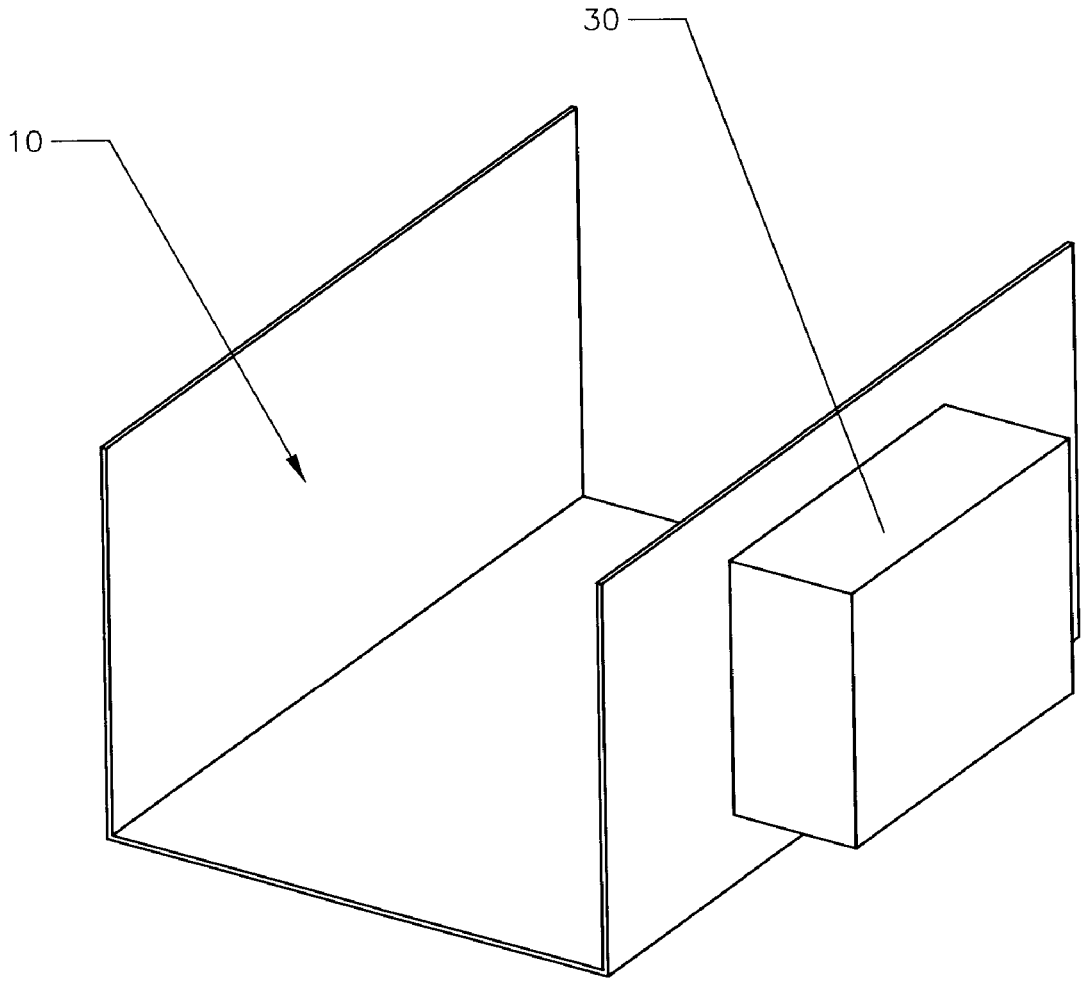
FIG. 2 is a perspective view of a preferred embodiment of the invention.

Turning now to FIG. 2, there is shown a perspective view of the present invention in a preferred embodiment. The invention 10 consists of a rigid heat conductive metallic element affixed to a heat transfer system 30. It is not the object of this invention to elaborate on the technology of heat transfer system 30; its function is to actively facilitate heat transfer from the heat conductive metallic element 10 to the surrounding ambient environment. As an example, a solid-state heat pump, gas absorption, or compressor technologies can be used as active heat transfer system. The heat transfer system 30 represented in the drawings is a concept assembly, not an actual device. Heat transfer system 30 in effect, can actively cool or heat the rigid heat conductive metallic element 10 via a thermal bond such as direct contact. As shown in FIG. 2, the rigid heat conductive metallic element 10 consists of support panels.

Figure 3:
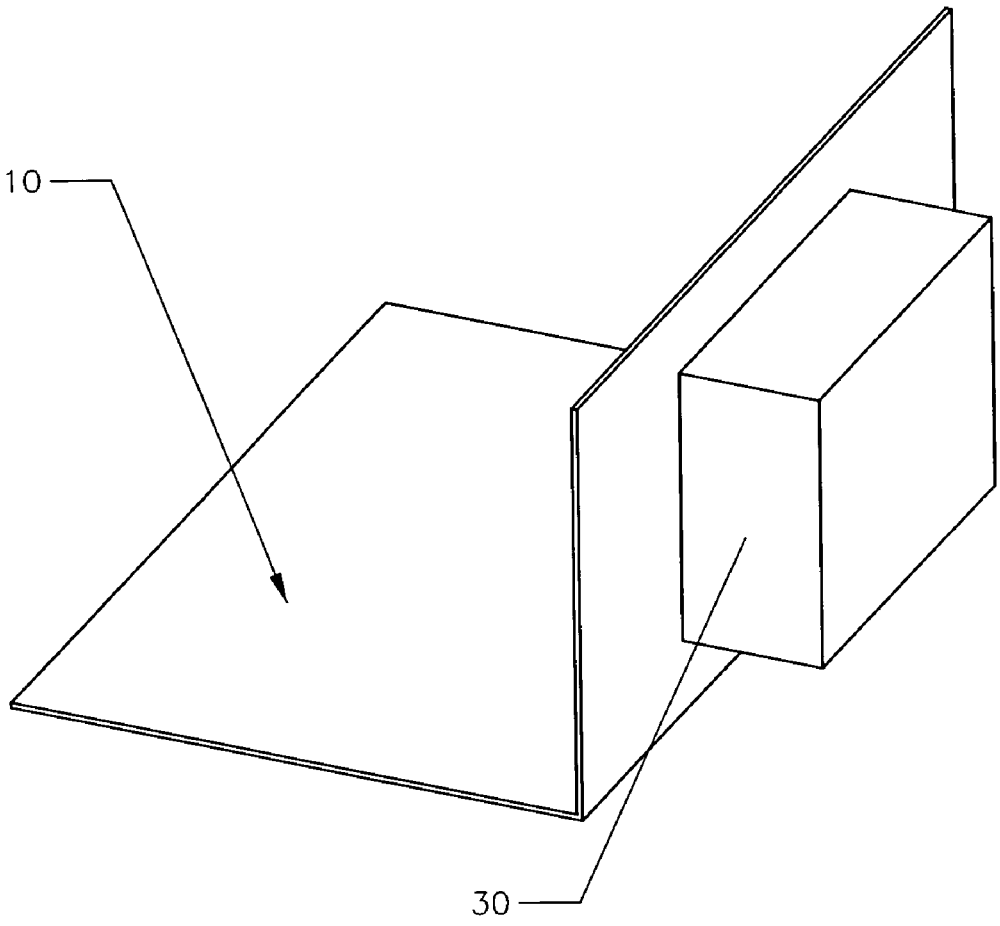
FIG. 3 is a perspective view of an alternate preferred embodiment of the invention.

Turning now to FIG. 3, there is shown a perspective view of an alternate preferred embodiment of the invention, where the rigid heat conductive metallic element 10 consists of only two panels. The invention is not limited to, but comprises, design configurations as shown in FIG. 2 and FIG. 3.

Figure 4:
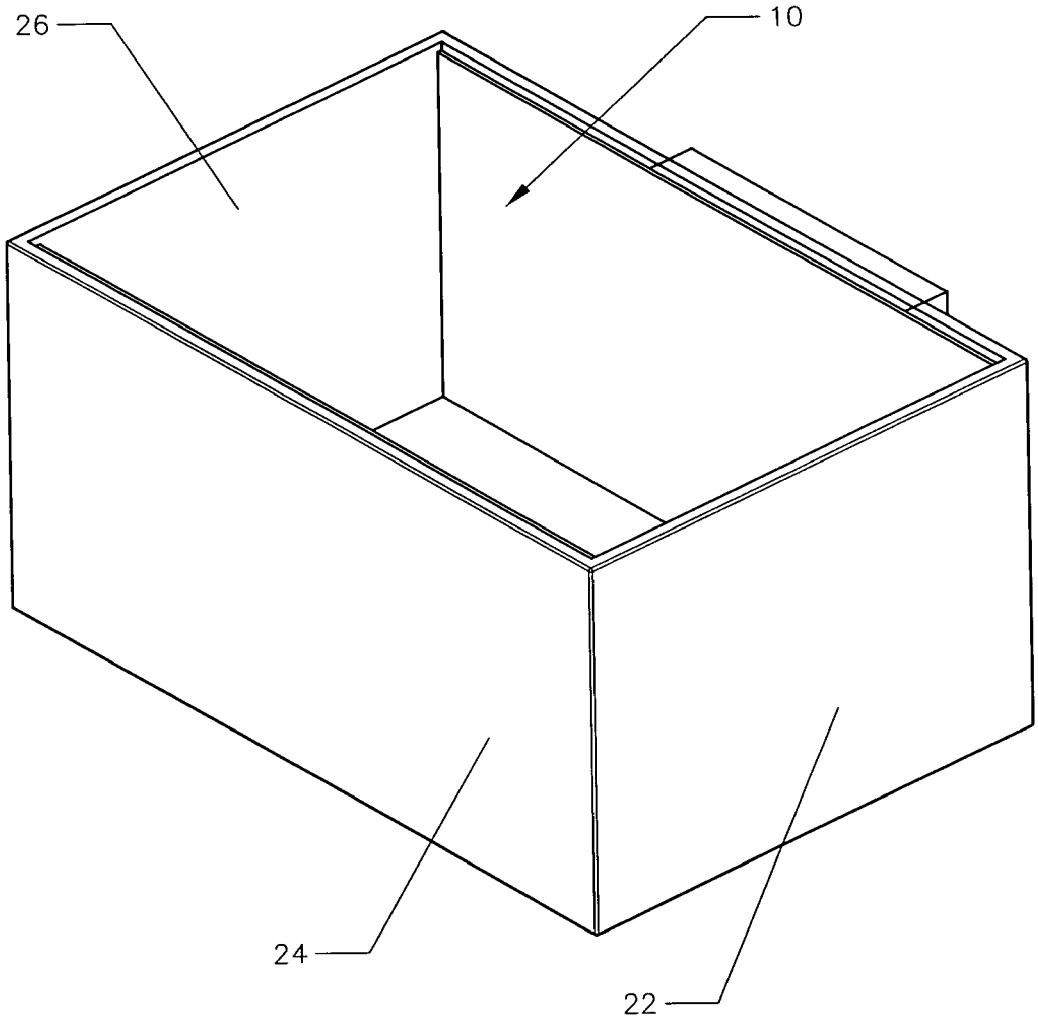
FIG. 4 is a perspective view of the invention installed in a preferred embodiment with closure removed.

Turning now to FIG. 4 there is shown a perspective view of the present invention with the closure mean of flexible insulated container 20 removed for the purpose of this description. The closure mean can consists of a flexible panel with mean of resealable closure by way of zipper pull, Velcro, or other. FIG. 4 shows the flexible insulated container forming a closed volume (resealable closure mean not represented) using a plurality of flexible walls such as 22, 24, and 26. It is important to note the invention does sets neither the shape nor the quantity of flexible walls, so long a closed volume is formed. Flexible walls 22, 24, 26 and other flexible walls forming the closed volume form a flexible and sealed connection with their respective adjacent flexible walls, a practical application of this aspect of the present invention is to use a one piece flexible material folded to form a closed volume. Folding of one piece rather than using a plurality of separate panels secured together facilitate good sealing of such volume. Flexible walls comprise a flexible outer liner, a flexible waterproof inner liner, and an insulating mean in between. Example of suitable materials for a practical application of the invention can be Nylon, PVC, PET fiber, or other flexible materials. It is a critical aspect of this invention that the material of the inner liner be waterproof.

FIG. 4 also represents the rigid heat conductive metallic element 10 structurally supporting the flexible insulated container by way of direct contact with the flexible walls. Although the walls are flexible, there are restricted in their movement by the invention. The invention structurally supports the general shape of the flexible insulated container. It is important to note the invention is located within the closed volume of the flexible insulated container; it is an integral part of it. It is a critical aspect of this invention that the rigid heat conductive metallic element 10 be of sufficient thickness to adequately support the mass of a content placed inside the flexible insulated container to prevent excessive deformation. Yet, as shown in FIG. 4 and following an alternate design as shown in FIG. 3, the rigid heat conductive metallic element 10 does not always need to support all panels of the flexible insulated container to allow some deformation of the flexible wall, those that are not structurally supported by the invention, to allow easier fit of a content. The physical bond between the rigid heat conductive element 10 and flexible insulated container 20 is waterproof, easily achieve in a practical application using silicon or other waterproof material and proper workmanship.

Another aspect of the invention is that because of the waterproof and thermal bond property of the connection between the rigid heat conductible element 10 and the flexible insulated container 20, the invention can passively retain the thermal property of the closed volume. When sealed, and with the active heat transfer system 30 off, the invention allows to keep cool or hot for an extended period of time the content of the flexible insulated container, the metallic element absorbs calories, and the insulated container slows the movement of such calories.

To conclude, the present invention combines the advantages of prior technologies and overcomes their deficiencies. The present invention allows for the use of a flexible material for the container, which is less invading, easier to use, yet, supports the container where other prior technologies would excessively deform and allows for passive or active heat transfer, all in one piece, compact, easy to manufacture element.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Structural Support Apparatus With Active or Passive Heat Transfer System comprising:

a flexible insulated container;

a rigid heat-conductive metallic element; and a heat exchange system;

where the metallic element structurally supports the container;

where the metallic element and container form a waterproof bond; and where the metallic element and heat exchange system form a thermal bond.

2. Structural Support Apparatus With Active or Passive Heat Transfer System as claimed in claim 1 wherein said flexible insulated container forms a closed volume with a plurality of flexible walls.

3. Structural Support Apparatus With Active or Passive Heat Transfer System as claimed in claim 2 wherein said plurality of flexible walls form a sealed connection with adjacent said plurality of flexible walls and where said connection is flexible.

4. Structural Support Apparatus With Active or Passive Heat Transfer System as claimed in claim 3 further comprising a resealable closure means on at least one said sealed connection.

5. Structural Support Apparatus With Active or Passive Heat Transfer System as claimed in claim 2 wherein said plurality of flexible walls comprises a flexible outer liner, a flexible waterproof inner liner, and a flexible insulating mean in between said flexible outer liner and said flexible waterproof inner liner.

6. Structural Support Apparatus With Active or Passive Heat Transfer System as claimed in claim 1 wherein said rigid heat-conductive metallic element is located within the closed volume of said flexible insulated container.

7. Structural Support Apparatus With Active or Passive Heat Transfer System as claimed in claim 6 wherein said rigid heat-conductive metallic element's structurally supports the general shape of said flexible insulated container.

8. Structural Support Apparatus With Active or Passive Heat Transfer System as claimed in claim 6 wherein said rigid heat-conductive metallic element structurally supports a content's mass of said flexible insulated container.

9. Structural Support Apparatus With Active or Passive Heat Transfer System as claimed in claim 1 wherein said waterproof bond insures direct physical contact isolation between said heat exchange system and a content of said flexible insulated container.

10. Structural Support Apparatus With Active or Passive Heat Transfer System as claimed in claim 1 wherein said heat exchange system actively facilitates or passively impairs heat transfer between a content of said flexible insulated container and surrounding environment of the present invention.

* * * * *